US006550219B2

(12) United States Patent
Liao

(10) Patent No.: US 6,550,219 B2
(45) Date of Patent: Apr. 22, 2003

(54) SPEED ADJUSTABLE PACKAGING MACHINE

(75) Inventor: Benker P. C. Liao, Taipei (TW)

(73) Assignee: Benison & Co., Ltd., Taipei (TW)

( * ) Notice: Subject to any disclaimer, the term of this patent is extended or adjusted under 35 U.S.C. 154(b) by 6 days.

(21) Appl. No.: 09/867,480

(22) Filed: May 31, 2001

(65) Prior Publication Data

US 2002/0178691 A1 Dec. 5, 2002

(51) Int. Cl.[7] ..... B65B 51/10
(52) U.S. Cl. ..... 53/374.6; 53/374.9; 493/475
(58) Field of Search ..... 53/374.9, 373.7, 53/375.9, 374.6; 493/475, 478

(56) References Cited

U.S. PATENT DOCUMENTS 4,079,662 A * 3/1978 Puccetti et al.
4,416,104 A * 11/1983 Yamada
4,611,455 A * 9/1986 Aiuola et al.
5,675,958 A * 10/1997 Shanklin et al.
5,761,878 A * 6/1998 Walkiewicz, Jr. et al.
6,295,790 B1 * 10/2001 McGregor et al.
6,347,499 B1 * 2/2002 McGregor et al.

* cited by examiner

*Primary Examiner*—Eugene Kim
(74) *Attorney, Agent, or Firm*—Rosenberg, Klein & Lee

(57) ABSTRACT

A packaging machine includes a machine chassis and a sealing device supported on the machine chassis. The sealing device includes upper and lower movable members each carrying heat-sealing blades for performing heat-sealing operation of a package film enclosing an article to be packaged. A driving system is arranged in the machine chassis, including a power cylinder or a solenoid mechanically coupled to the upper and lower movable members by a linkage for reciprocally driving the upper and lower members between an open position where the members are separated from each other at a predetermined distance and a closed position where the heat-sealing blades engage each other. An adjustment device includes a screw rod threadingly engaging the machine chassis and a platform attached to an end of the screw rod. The power cylinder is pivotally attached to the platform whereby when the screw rod is rotate to change the position of the power cylinder with respect to the machine chassis, the distance between the movable members is changed in correspondence thereto. Changing the distance between the movable members causes a change of the operation speed of the sealing device.

12 Claims, 7 Drawing Sheets

SPEED ADJUSTABLE PACKAGING MACHINE

FIELD OF THE INVENTION

The present invention generally relates to a packaging system comprising a sealing device for forming a sealing line on a package film enclosing an article and thus packaging the article, and in particular to a packaging system capable to adjust the operation speed thereof for accommodating different assembly lines of the articles to be packaged.

BACKGROUND OF THE INVENTION

Package films made of plastics or other heat sealable materials are widely used in packaging a variety of products, such as foods, compact disks for computer software and music and books, to protect the products from being damaged or contaminated. In a packaging process, a package film is placed around an article to be packaged. Edges of the package film is then heated to seal together along sides of the article.

A conventional packaging machine forms an L-shaped sealing line along two adjacent sides of an article to be packaged. Movable members carrying heat-sealing blades are allowed to move with respect to each other for engaging and thus forming a sealing line on the package film enclosing an article. The overall efficiency of the conventional packaging machine is thus dependent upon the cycle time that is required for the movable members to engage each other and then separate again. In the conventional packaging machine, the distance between the movable members when they are separated from each other is in general constant. Thus, the cycle time is fixed. When the conventional packaging machine is incorporated in an assembly line for packaging articles manufactured in the assembly line, the assembly line may suffer an undesired reduction of overall efficiency due to inconsistency in operation speed between the packaging machine and the assembly line.

It is desired to provide a packaging machine for overcoming the above mentioned problems.

SUMMARY OF THE INVENTION

Accordingly, an object of the present invention is to provide a packaging machine that is capable of adjustment of operation speed and thus operation efficiency.

Another object of the present invention is to provide a packaging machine comprising movable sealing blades distanced from each other, the distance therebetween being adjustable for changing the operation speed of the packaging machine.

To achieve the above objects, in accordance with the present invention, there is provided a packaging machine comprising a machine chassis and a sealing device supported on the machine chassis. The sealing device comprises upper and lower movable members each carrying heat-sealing blades for performing heat-sealing operation of a package film enclosing an article to be packaged. A driving system is arranged in the machine chassis, comprising a power cylinder or a solenoid mechanically coupled to the upper and lower movable members by a linkage for reciprocally driving the upper and lower members between an open position where the members are separated from each other at a predetermined distance and a closed position where the heat-sealing blades engage each other. An adjustment device comprises a screw rod threadingly engaging the machine chassis and a platform attached to an end of the screw rod. The power cylinder is pivotally attached to the platform whereby when the screw rod is rotate to change the position of the power cylinder with respect to the machine chassis, the distance between the movable members is changed in correspondence thereto. Changing the distance between the movable members causes a change of the operation speed of the sealing device.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
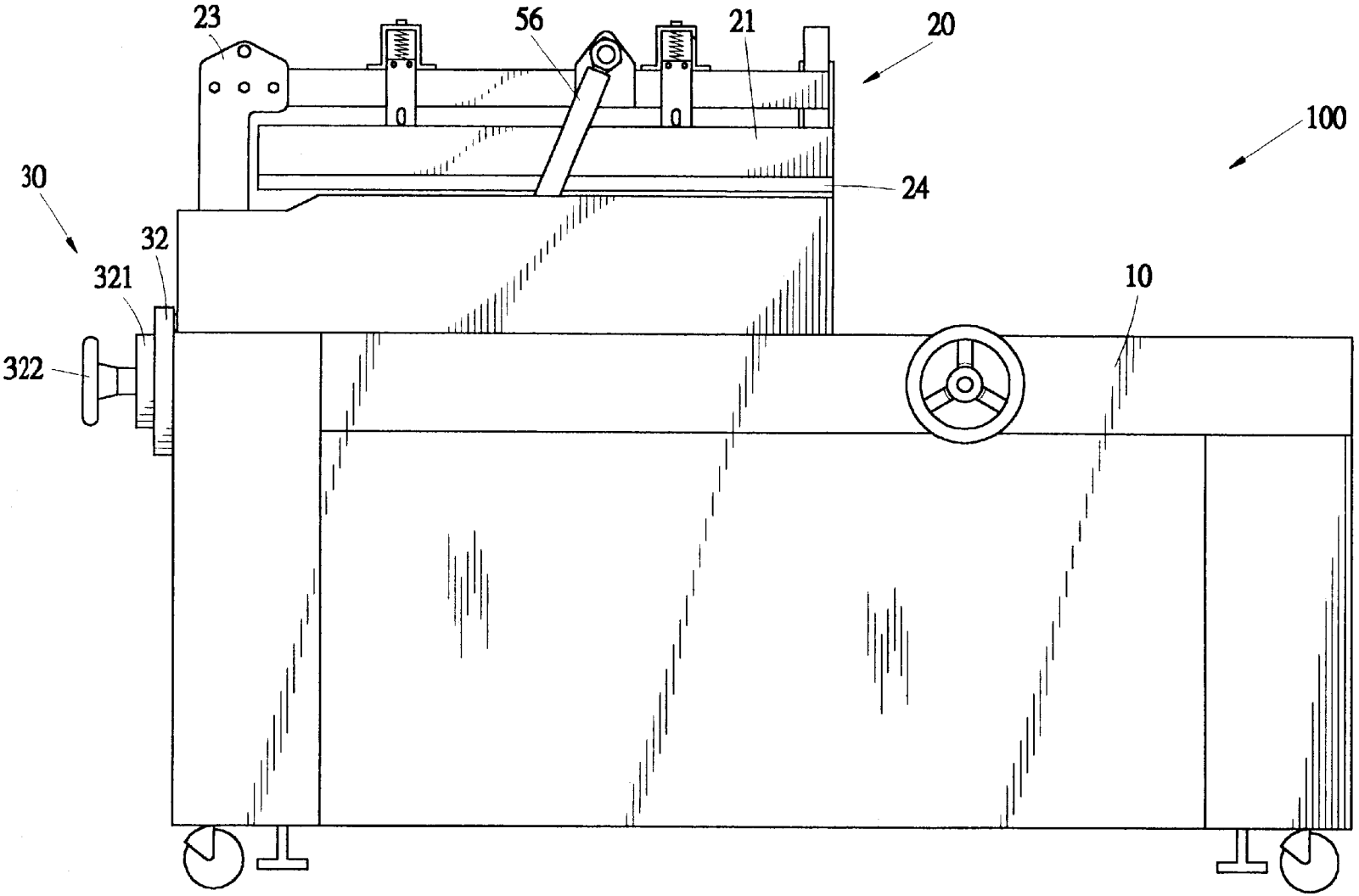
FIG. 1 is a side elevational view showing a packaging machine constructed in accordance with the present invention.
Figure 2:
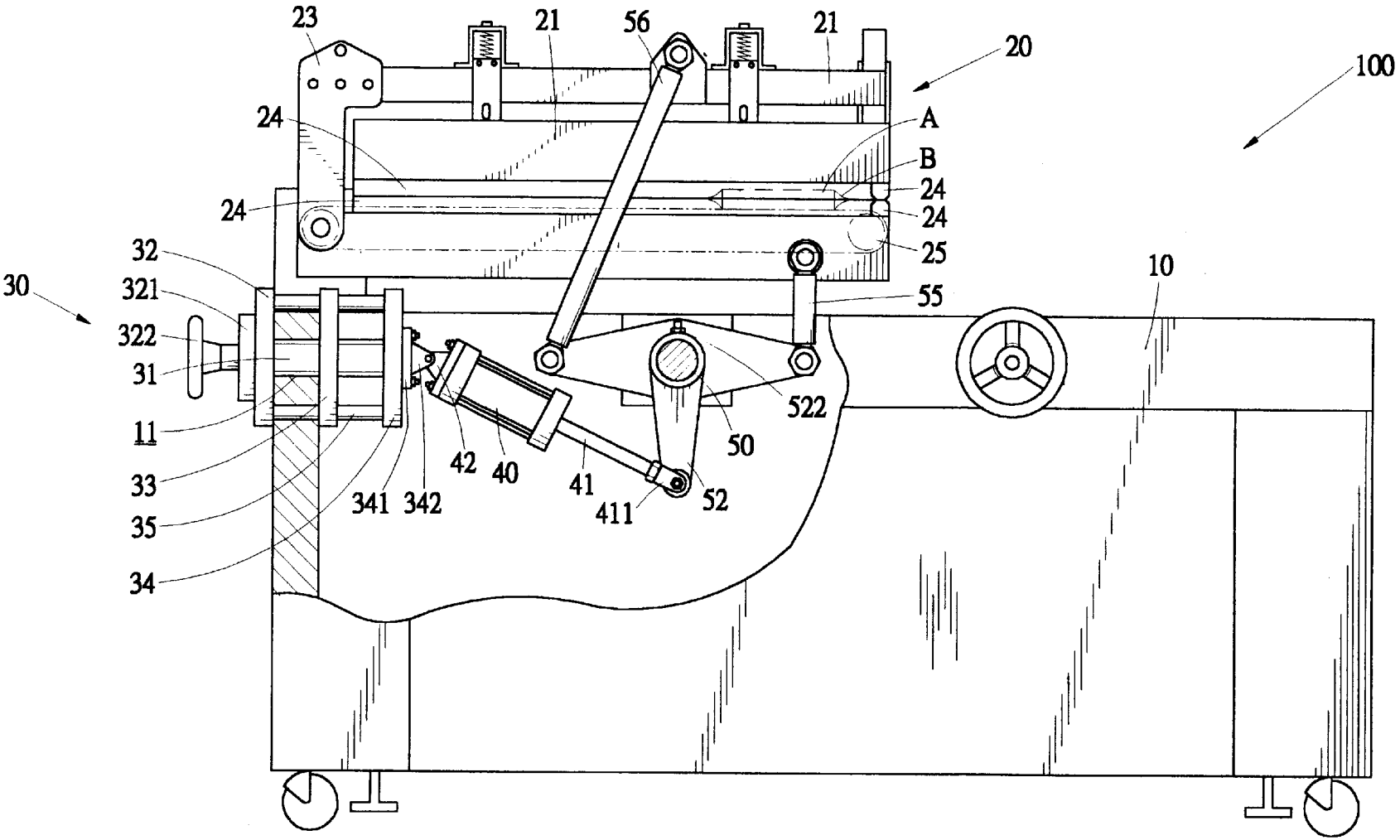
FIG. 2 is similar to FIG. 1 with a portion of the packaging machine being broken to show inside structure thereof.

With reference to the drawings and in particular to FIGS. 1 and 2, a speed adjustable packaging machine constructed in accordance with the present invention, generally designated with reference numeral 100, comprises a machine chassis 10 on which a sealing device 20 is mounted. The sealing device 20 comprises upper and lower members 21, 22 sized and positioned in correspondence to each other. In the embodiment illustrated, the upper and lower members 21, 22 are rectangular members having a front edge and opposite lateral edges substantially corresponding to each other in spatial relationship. The upper member 21 has an extension 23 pivoted to the lower member 22 thereby allowing the upper and lower members 21, 22 to pivot with respect to each other between a closed position (FIG. 6) where the upper and lower members 21, 22 engaging each other and an open position (FIG. 5) where an opening angle $\theta_1$ is defined between the upper and lower members 21, 22 and an opening distance $L_1$ is formed between the front edges of the upper and lower members 21, 22.

A conveyor belt 25 is arranged between the upper and lower members 21 for conveying an article A enclosed by a package film B through the sealing device 10. Heat-sealing blades 24 are attached to the upper and lower members 21, 22. When the upper and lower members 21, 22 are in the open position, the article A is moved by the conveyor belt 25 to a position between the upper and lower members 21, 22. The upper and lower members 21, 22 are then driven to the closed position to have the heat-sealing blades 24 engaging and performing sealing operation on the package film B. In the embodiment illustrated, two heat sealing blades 24 are respectively attached to each of the members 21, 22, partially extending along the front edge and one lateral edge of the member 21, 22 whereby an L-shaped sealing line may be formed on the package film B for packaging the article A.

An adjustment device 30 is attached to the machine chassis 10 and mechanically coupled to the upper and lower members 21, 22 for controlling the opening angle and the opening distance of the sealing device 20.

Figure 3:
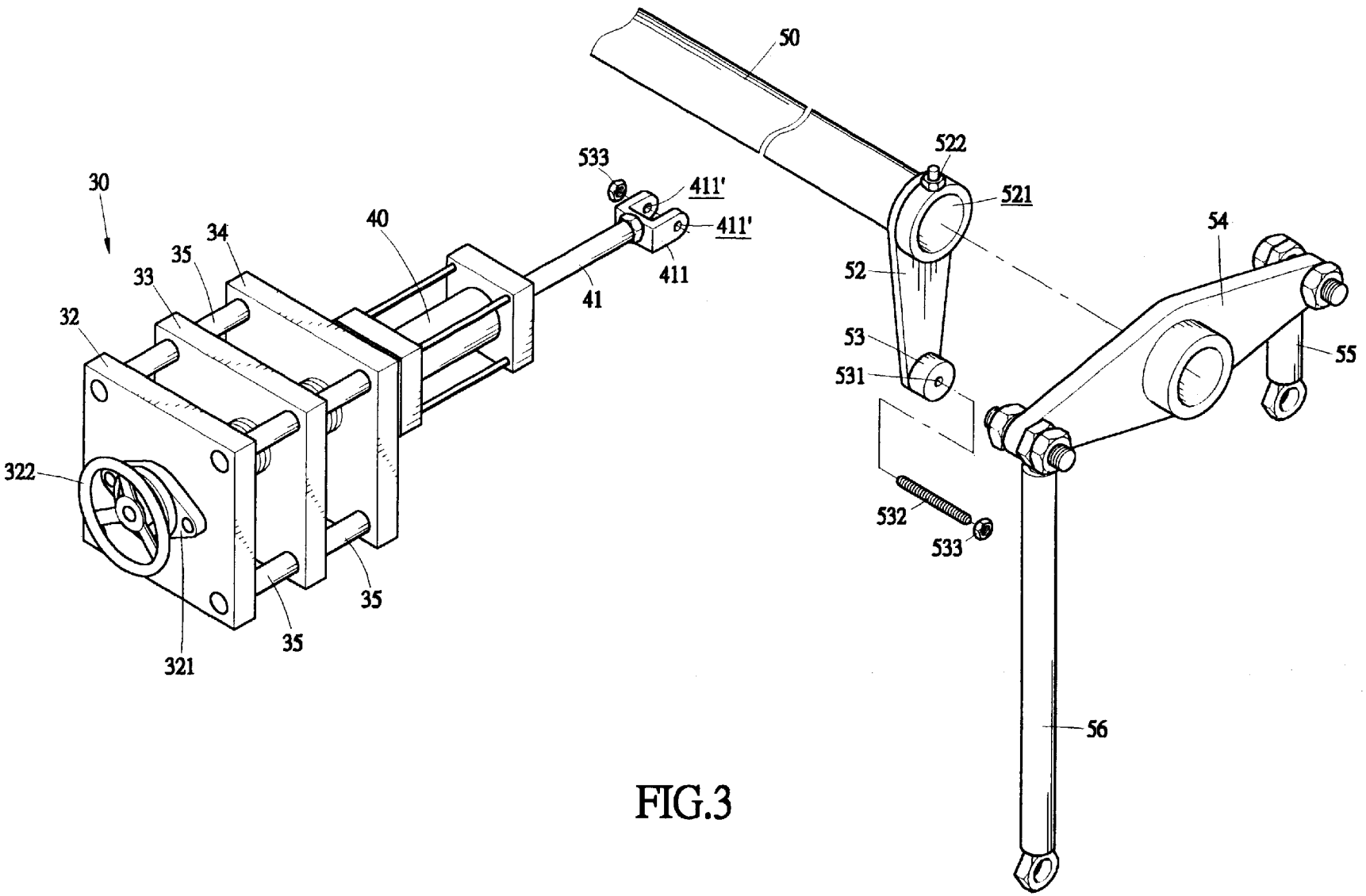
FIG. 3 is an exploded view showing a mechanical connection between an adjustment device, a driving device and a cross bar of the packaging machine of the present invention.
Figure 4:
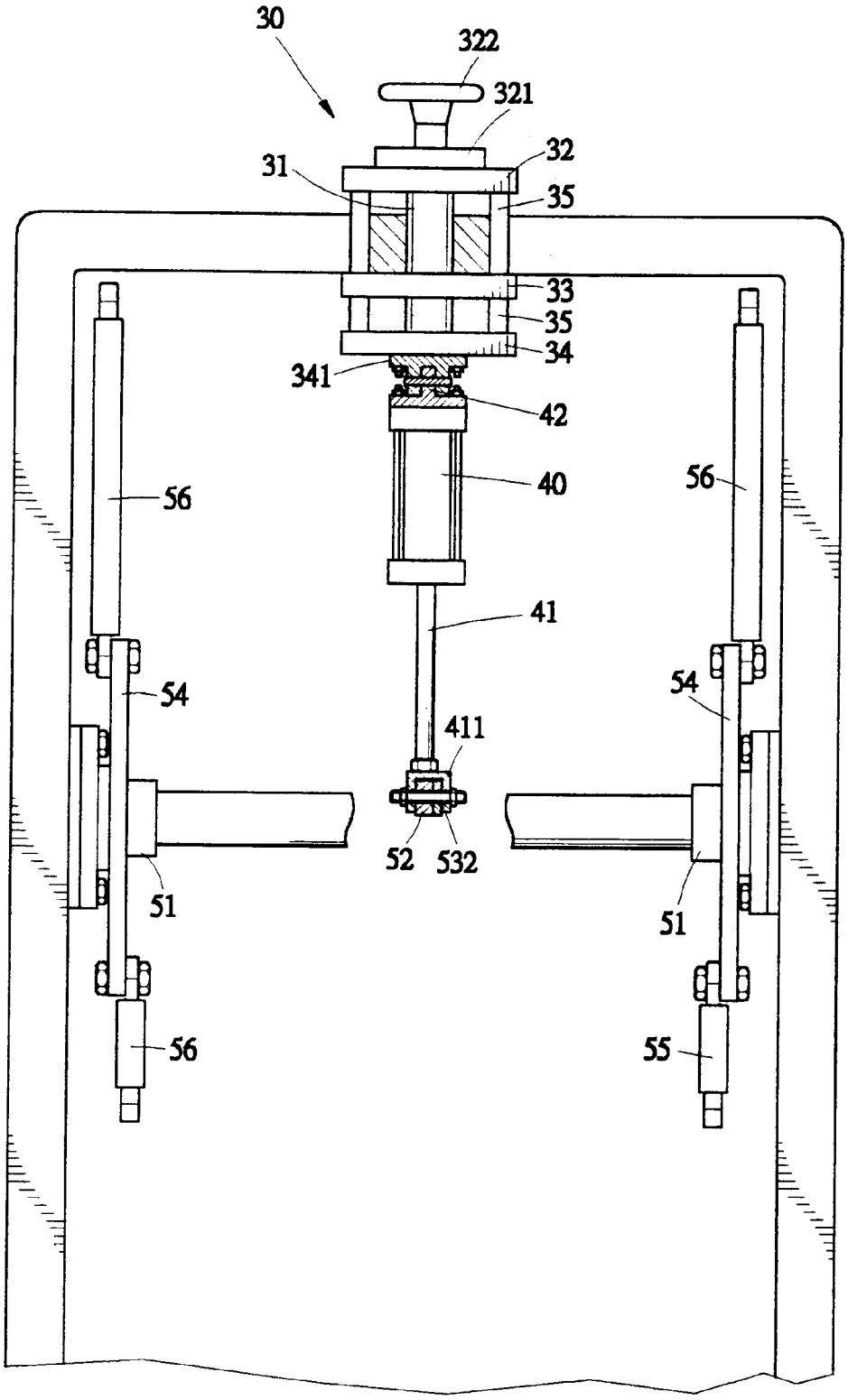
FIG. 4 is a top plan view of the speed adjustable packaging machine of the present invention with a sealing device thereof removed for clarity.

Also referring to FIGS. 3 and 4, the adjustment device 30 comprises a base comprising outer and inner movable boards 32, 34 and a fixed board 33 arranged between and spaced from the movable boards 32, 34. Posts 35 are fixedly mounted to the movable boards 32, 34 and movably extends through the fixed board 33. The fixed board 33 is fixed to an end wall (not labeled) of the machine chassis 10, allowing the movable boards 32, 34 to move with respect to the machine chassis 10. A screw rod 31 threadingly engages the end wall of the machine chassis 10 with opposite ends of the rod 31 attached to the movable boards 32, 34 by retaining/bearing means 321, 341 whereby rotation of the screw rod 31 by a hand wheel 322 causes the movable boards 32, 34 to move forward (in a direction "entering" the machine chassis 10) or backward (in an opposite direction "leaving" the machine chassis 10), as indicated by arrow of FIG. 7.

Figure 5:
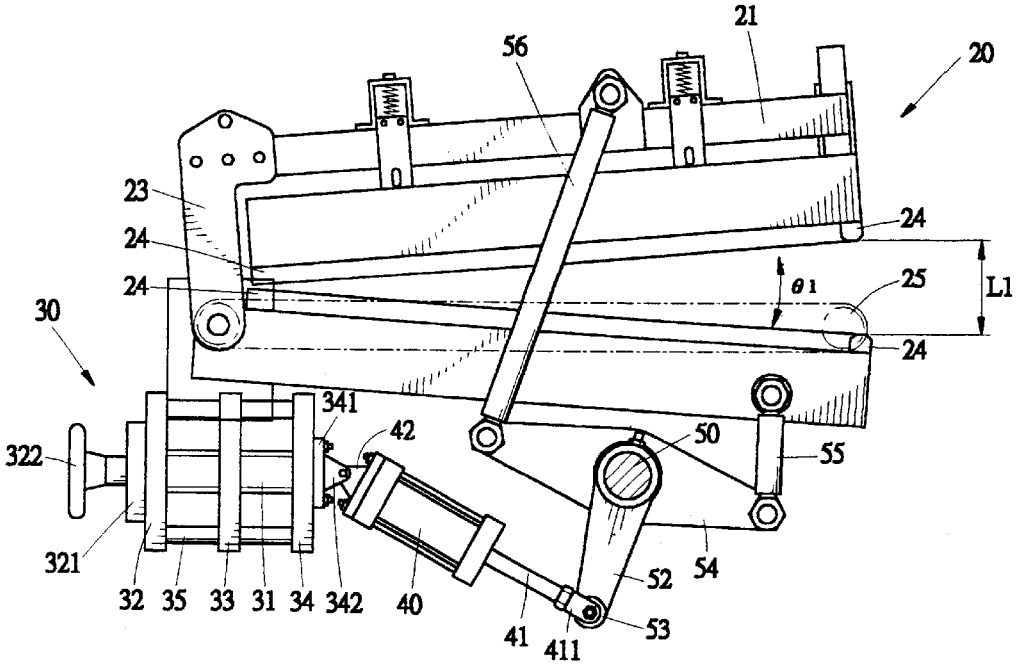
FIG. 5 is a side elevational view of the speed adjustable packaging machine of the present invention with a machine chassis removed, showing the sealing device of the packaging machine at the open position.

A driving device 40, such as a pneumatic cylinder and a solenoid, is mounted to the inner movable board 34. Two lugs 342, spaced from and opposing each other, are formed on the inner board 34 for receiving an end 42 of the driving device 40 with a pivot (not labeled) extending through both the end 42 and the lugs 342, forming a knuckle joint which allows the driving device 40 to pivot with respect to the inner board 34. The driving device 40 comprises an extendible rod 41 which is selectively driven by the driving device 40 between an extended position (FIG. 6) and a retracted position (FIG. 5). Two lugs 411, spaced from and opposing each other, are formed on a remote end of the rod 41.

A cross bar 50 extends between opposite side walls of the machine chassis 10 and is rotatably supported by bearing means 52 attached to each side wall of the machine chassis 10. A link 52 has a first end forming a ring 521 snugly fit over the cross bar 50. The ring 521 of the link 52 is securely fixed to the cross bar 50 by a screw 522. A second end of the link 52 forms a cylindrical projection 53 sized to be received between the lugs 411 of the extendible rod 41 of the driving device 40. An axial bore 531 is defined in the cylindrical projection 53 and a corresponding hole 411' is defined in each lug 411 for receiving a pivot pin 532, forming a knuckle joint that allows the link 52 to rotate with respect to the extendible rod 41. Threading is formed on the pivot pin 532 for engaging nuts 533 to secure the pivot pin 533, preventing the link 52 from separating from the extendible rod 41. When the extendible rod 41 is driven between the extended position and the retracted position, due to the knuckle joints formed between the inner board 34 and the driving device 40 and between the extendible rod 41 and the link 52, the link 52 and thus the cross bar 50 rotate about a central axis of the cross bar 50 in reciprocal fashion.

Figure 6:
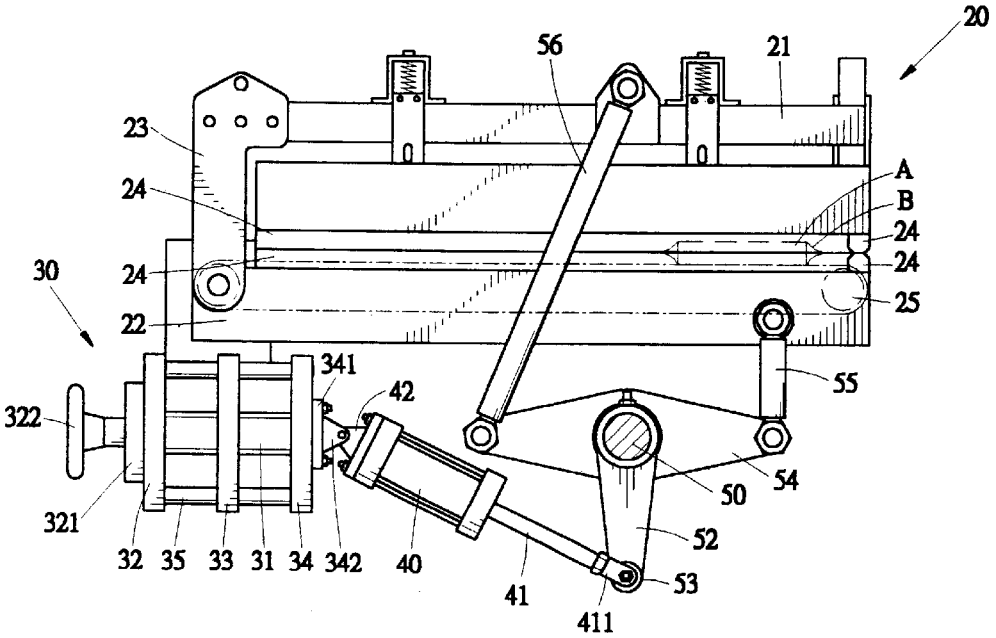
FIG. 6 is similar to FIG. 5 but showing the sealing device at the closed position.

Also referring to FIGS. 5 and 6, two rocking arms 54 are secured to the cross bar 50 to rotate therewith. In the embodiment illustrated, the rocking arms 54 are located substantially corresponding to the lateral edges of the upper and lower members 21, 22. Each rocking arm 54 has ends respectively pivoted to first and second connecting rods 55, 56 which are in turn pivoted to the lower and upper members 22, 21 respectively.

By means of the mechanical connection between the driving device 40 and the fist and second connecting rods 55, 56 as described above, when the extendible rod 41 is moved to the retracted position, the cross bar 50 is rotated in a first angular direction to a first angular position where the first and second connecting rods 55, 56 drive the upper and lower members 21, 22 to reach the open position with the front edges of the upper and lower members 21, 22 separated from each other at the opening distance $L_1$ and the opening angle $\theta_1$ formed between the upper and lower members 21, 22.

When the extendible rod 41 is moved from the retracted position to the extended position, the cross bar 50 is rotated in a second angular direction from the first angular position to a second angular position where the first and second connecting rods 55, 56 drive the upper and lower members 21, 22 from the open position to the closed position, causing the heat-sealing blades 24 of the upper and lower members 21, 22 to engage each other for performing sealing operation.

It is understood that the overall operation efficiency is dependent upon the opening distance $L_1$ and the opening angle $\theta_1$. The smaller the opening distance $L_1$ is, the higher the operation efficiency is, because the upper and lower members 21, 22 only need to travel a smaller distance in reaching the closed position.

Figure 7:
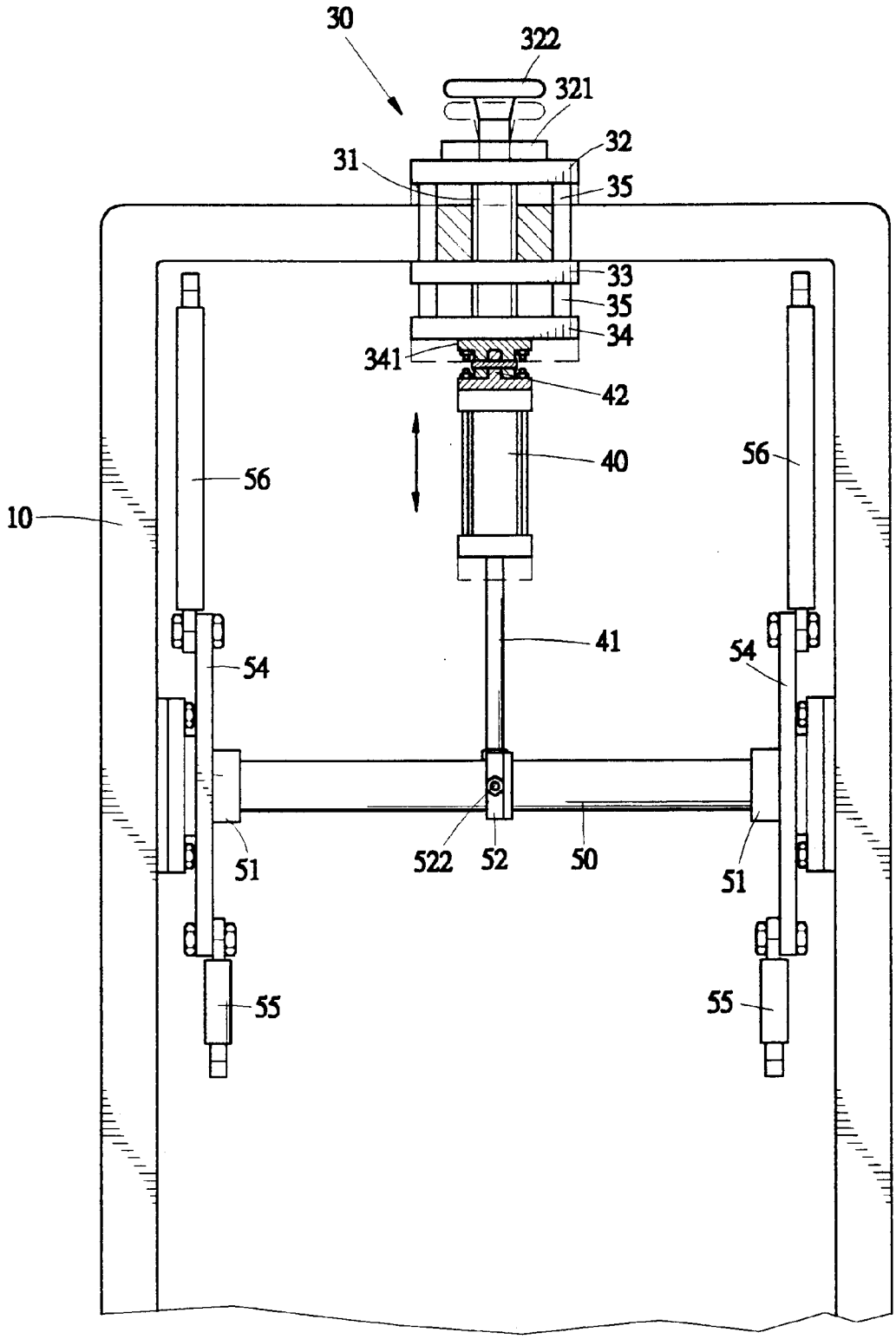
FIG. 7 is a top plan view of the speed adjustable packaging machine of the present invention with a sealing device removed for showing the operation of the driving device.
Figure 8:
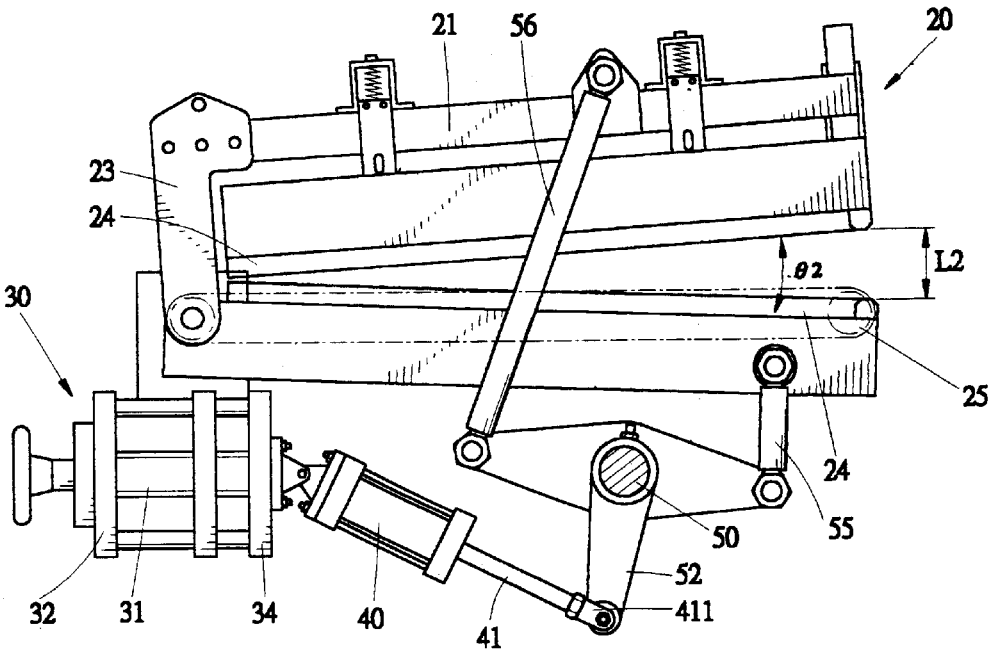
FIG. 8 is a side elevational view of the speed adjustable packaging machine of the present invention with a machine chassis removed, showing an operation of reducing distance between the movable members of the sealing device.
Figure 9:
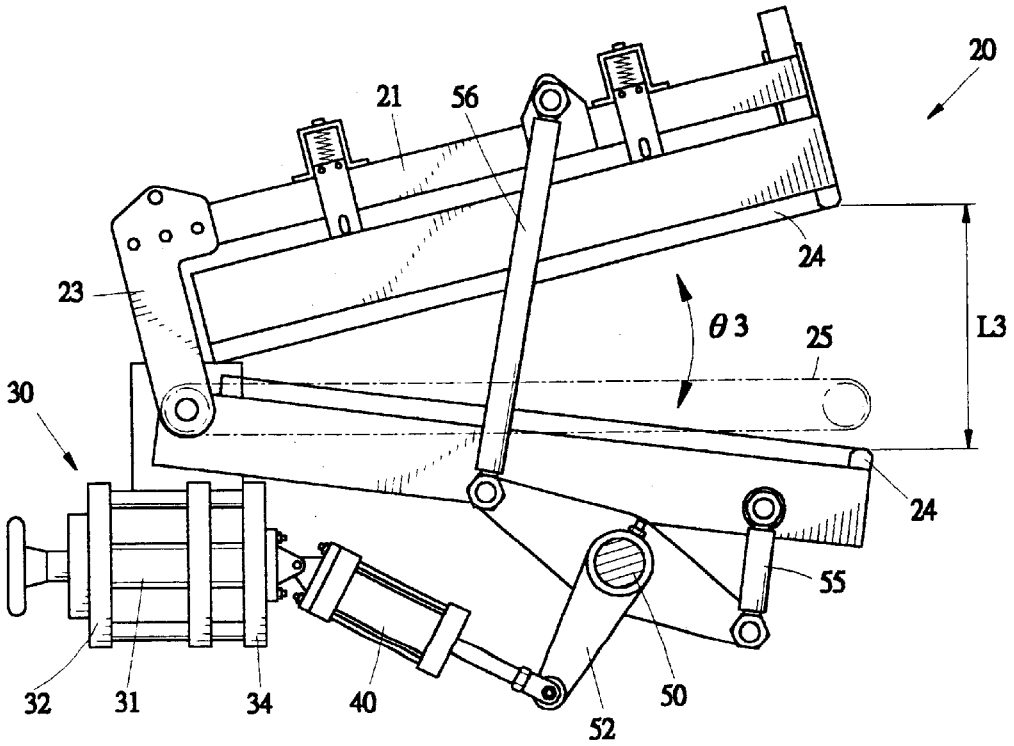
FIG. 9 is similar to FIG. 8 but showing an operation of increasing distance between the movable members of the sealing device.

With reference to FIGS. 7–9, assuming the upper and lower members 21, 22 are located at the open position thereof, by operating the adjustment device 30 to move the inner board 34 and thus the driving device 40 in the forward direction, namely the inner board 34 is moved further into the machine chassis 10, with the extendible rod 41 fixed with respect to the driving device 40, the cross bar 50 is driven to rotate in the second angular direction, causing the upper and lower members 21, 22 to move in a direction toward the closed position. By suitably selecting the dimensions of the extendible rod 41, the link 52, the rocking arms 54, and the first and second connecting rods 55, 56 and the displacement of the inner board 34 with respect to the machine chassis 10, a desired amount of reduction of the opening distance between the front edges of the upper and lower members 21, 22 can be achieved. As shown in FIG. 8, the opening distance is reduced from the original value $L_1$ to a smaller value $L_2$, a corresponding change of the opening angle $\theta_1$ to $\theta_2$ being achieved simultaneously.

When the inner board 34 is moved in the backward direction, all the movements of the moving parts described above are reversed, causing the upper and lower members 21, 22 to further separated from each other. The opening distance between the front edges of the upper and lower members 21, 22 is thus increased from $L_1$ to $L_3$ and a corresponding increase of the opening angle from $\theta_1$ to $\theta_3$ is also realized as shown in FIG. 9.

By operating the adjustment device 30, the operation efficiency of the packaging system of the present invention can be changed to accommodate different conveying speed of articles to be packaged. Furthermore, the sealing system of the present invention can be adjusted based on the above teaching to fit itself to different assembly lines having different speed in assembling the articles to be packaged.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A packaging machine adapted to form a sealing line on a package film enclosing an article, the packaging machine comprising a machine chassis;

a sealing device mounted to the machine chassis, the sealing device comprising upper and lower members movable with respect to each other between an open position where the upper and lower members are separated from each other at a predetermined distance for reception of the article and the package film therebetween and a closed position where the upper and lower members engage the package film for performing a sealing operation;

an adjustment device comprising a platform movable with respect to the machine chassis between a forward position and a backward position;

a driving device mounted to the platform, the driving device comprising an extendable rod having a remote end movable between an extended position and a retracted position;

a cross bar rotatably supported in the machine chassis and mechanically coupled to the extendible rod whereby when the extendible rod is moved from the extended position to the retracted position, the cross bar is rotated in a first angular direction from a first angular position to a second angular position and when the extendible rod is moved from the retracted position to the extended position, the cross bar is rotated in a second angular direction from the second angular position to the first angular position;

a rocking arm fixedly attached to the cross bar; and, first and second connecting rods respectively connected between the ends of the rocking arm and the upper and lower members whereby when the cross bar is rotated in the first angular direction from the first angular position toward the second angular position, the upper and lower members are driven by the first and second connecting rods from the open position to the closed position and when the cross bar is rotated in the second angular direction from the second angular position toward the first angular position, the upper and lower members are driven by the first and second connecting rods from the closed position to the open position, the platform of the adjusting device being selectively displaced between the backward position and the forward position to drive the cross bar to rotate and thereby change an opening distance between the upper and lower members in the open position.

2. The packaging machine as claimed in claim 1, wherein the upper member comprises an extension pivotally connected to the lower member whereby the upper and lower members are rotatable with respect to each other.

3. The packaging machine as claimed in claim 1, wherein the upper and lower members each have a front edge and a lateral edge to each of which a heat-sealing blade is attached.

4. The packaging machine as claimed in claim 1 further comprising a conveyor belt arranged between the upper and lower members.

5. The packaging machine as claimed in claim 1, wherein the adjustment device comprises a screw rod threadingly engaging a wall of the machine chassis, the platform being mounted to an inner end of the screw rod.

6. The packaging machine as claimed in claim 1, wherein the adjustment device further comprising (a) a fixed board fixedly attached to the wall of the machine chassis and spaced from the platform, the platform being formed by an outer movable board disposed external to the wall of the machine chassis, an inner movable board disposed internal to the wall of the machine chassis and having the driving device coupled thereto, and a plurality of posts having opposing ends respectively fixedly attached to the inner and outer movable boards and movably extending through the fixed board disposed between the inner and outer boards for guiding movement of the inner and outer boards and the driving device therewith, and (b) a screw rod threadedly engaged with the wall of the machine chassis and attached to the inner and outer boards for displacement thereof responsive to rotation of the screw rod.

7. The packaging machine as claimed in claim 5, wherein a hand wheel is attached to an outer end of the screw rod.

8. The packaging machine as claimed in claim 1, wherein the driving device is connected to the platform by a knuckle joint.

9. The packaging machine as claimed in claim 1, wherein the cross bar forms a transverse extension which is connected to the remote end of the extendible rod by a knuckle joint.

10. The packaging machine as claimed in claim 1, wherein the driving device comprises a power cylinder.

11. The packaging machine as claimed in claim 1, wherein the driving device comprises a solenoid.

12. The packaging machine as claimed in claim 1, wherein the first and second connecting rods each have two ends respectively pivoted to the rocking arm and the upper and lower members.

* * * * *